US005186668A

United States Patent [19]

Michael et al.

[11] Patent Number: 5,186,668

[45] Date of Patent: * Feb. 16, 1993

[54] NEGATIVE GLOW DISCHARGE LAMP

[75] Inventors: Joseph D. Michael, University Heights, Ohio; Radomir Lagushenko; Jakob Maya, both of Brookline, Mass.; Oscar Biblarz, Carmel, Calif.

[73] Assignee: GTE Products Corporation, Danvers, Mass.

[ * ] Notice: The portion of the term of this patent subsequent to Jun. 9, 2009 has been disclaimed.

[21] Appl. No.: 865,418

[22] Filed: Apr. 8, 1992

Related U.S. Application Data

[60] Continuation of Ser. No. 653,324, Feb. 11, 1991, Pat. No. 5,120,251, which is a division of Ser. No. 473,529, Feb. 1, 1990, abandoned.

[51] Int. Cl.[5] ..... H01J 9/395

[52] U.S. Cl. ..... 445/9; 445/40; 445/57

[58] Field of Search ..... 445/9, 16, 17, 18, 38, 445/57, 40; 313/490, 565, 619, 639

[56] References Cited

U.S. PATENT DOCUMENTS

| | | | |
|---|---|---|---|
| 1,565,564 | 12/1925 | Hageman | 445/18 |
| 1,826,387 | 10/1931 | Beck | 445/18 |
| 2,976,451 | 3/1961 | Reiling et al. | 313/639 |
| 3,957,328 | 5/1976 | van der Wolf et al. | 316/3 |
| 4,977,349 | 12/1990 | Asakura | 313/490 |

*Primary Examiner*—Richard K. Seidel
*Assistant Examiner*—Jeffrey T. Knapp
*Attorney, Agent, or Firm*—Carlo S. Bessone

[57] ABSTRACT

A negative glow discharge lamp having improved efficacy enabled by reducing the anode work function by the introduction of a metal-based gas into the lamp envelope for absorption on the anode. The metal-based gas is preferably cesium but may also, for example, be sodium.

3 Claims, 4 Drawing Sheets

NEGATIVE GLOW DISCHARGE LAMP

This is a continuation of co-pending application Ser. No. 07/653,324 filed on Feb. 11, 1991, now U.S. Pat. No. 5,120,251 which is a divisional of Ser. No. 07/473,529 filed on Feb. 1, 1990, now abandoned.

FIELD OF THE INVENTION

The present invention relates, in general, to negative glow discharge lamps and pertains, more particularly, to such a lamp in which the fill material includes not only, for example, mercury and a noble gas, but also a metal-based gas such as cesium, which enhances the overall efficiency of the lamp by reducing the power required to drive the electron discharge.

BACKGROUND OF THE INVENTION

Most mercury negative glow discharge lamps employ an electrode structure made from tungsten. The following are typical samples of mercury negative glow discharge lamps as disclosed in the prior art: U.S. Pat. Nos. 4,521,718; 4,518,897; 4,516,057; 4,494,046; 4,450,380; 4,413,204. The electrode structure which comprises a thermionic cathode and a bare anode, provides for electron emission or discharge, which in turn triggers the process for producing visible light. The work function of a typical tungsten anode is approximately 4.55 electron volts, and is defined as the potential energy barrier that an electron must overcome during emission. Due to this potential energy barrier, sufficient energy must be supplied for adequate electron emission and an inefficient energy transfer results.

OBJECTS OF THE INVENTION

Accordingly, it is an object of the present invention to provide a mercury negative glow discharge lamp which maximizes the efficiency of the energy transfer that takes place.

Another object of the present invention is to provide a discharge lamp in which the power required to drive the electron emission process is reduced.

A further object of the present invention is to provide a discharge lamp in which the work function potential energy barrier of the tungsten anode is reduced.

SUMMARY OF THE INVENTION

To accomplish the foregoing and other objects, features and advantages of the invention there is provided a negative glow discharge lamp that is constructed with a light transmitting envelope, a phosphor coating on the inner surface of the envelope, and an electrode means for establishing an electron emission. The improvement, in accordance with the present invention, resides in providing a fill material that in particular includes a metal-based gas, preferably cesium, which coats the tungsten anode of the electrode means, and reduces the work function associated therewith. This metal-based gas is selected to have a low ionization potential. A lamp of the present invention is characterized by having a much higher energy conversion efficiency than its pure mercury counterpart, by virtue of the fact that the cesium impurity reduces the work function potential energy barrier of the tungsten anode by about 50%.

BRIEF DESCRIPTION OF THE DRAWINGS

Numerous other objects, features and advantages of the invention should now become apparent upon a reading of the following detailed description taken in conjunction with the accompanying drawings, in which.

DESCRIPTION OF THE PREFERRED EMBODIMENT

Figure 1:
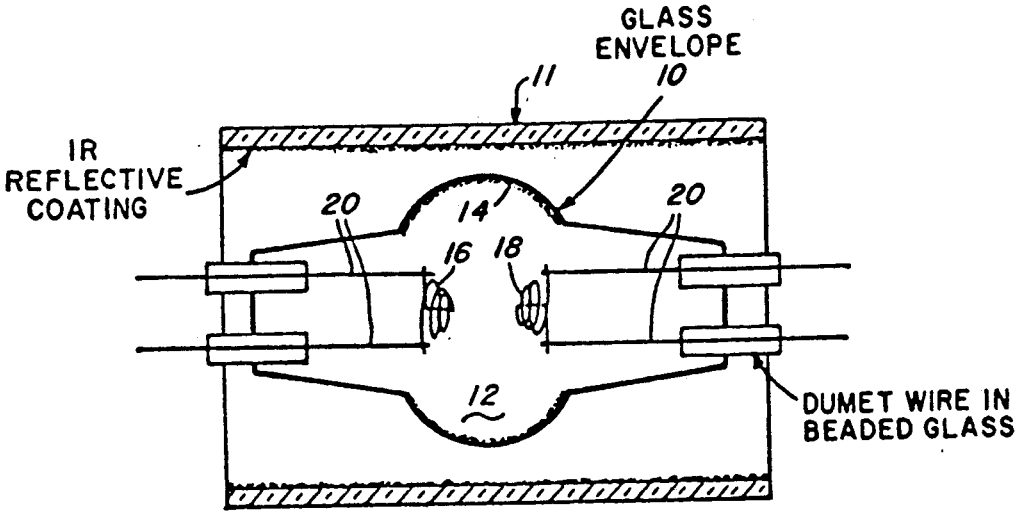
FIG. 1 is a schematic diagram of a negative glow discharge lamp constructed in accordance with the principles of the present invention.

Referring to FIG. 1, a negative glow discharge lamp according to the present invention is shown. A vacuum type lamp envelope 10 made of a light transmitting substance, such as glass, encloses a discharge volume 12. The discharge volume 12 contains a fill material which both emits ultraviolet radiation upon excitation and serves to reduce the power required to drive the electron discharge. The fill material includes a cesium-mercury mixture as well as a noble gas. One such noble gas is neon. The mercury serves to emit ultraviolet radiation upon excitation while the cesium serves to coat the tungsten anode and reduce its potential energy barrier or work function.

The inner surface of the lamp envelope 10 has a phosphor coating 14 which emits visible light upon absorption of ultraviolet radiation. Also shown in FIG. 1 is the evacuated outer glass jacket 11 which is coated with an infrared reflecting material to elevate the cold spot temperature of the lamp. Also enclosed within the discharge volume 12 of the lamp envelope 10, is a cathode 16 and an anode 18.

In general, the function of the cathode 16 is to emit electrons, while the function of the anode is to accelerate the electrons emitted by the cathode 16. The cathode 16 and anode 18 are both made from tungsten and the cathode 16 is coiled and coated with an emissive material to aid in electron emission, while the anode 18 is left bare.

Supporting conductors 20 provide for electrical connection to a single power supply through the envelope 10 in a vacuum tight seal. During operation, a voltage is applied via conductors 20 to the thermionic cathode 16, to provide for a readily available supply of electrons.

The work function of the pure tungsten anode is approximately 4.55 electron volts. The work function is defined as the amount of energy required for an electron to surmount the potential energy barrier. For a 2.0 amperage discharge current, the wasted power loss due to this phenomenon is of the order of 9.0 watts, which is substantial for a lamp which operates at approximately 30 watts of power. In accordance with the present invention, a metal-based gas, such as cesium, is introduced as a tungsten impurity to reduce the work function and overall power required to drive the electron discharge.

Figure 3:
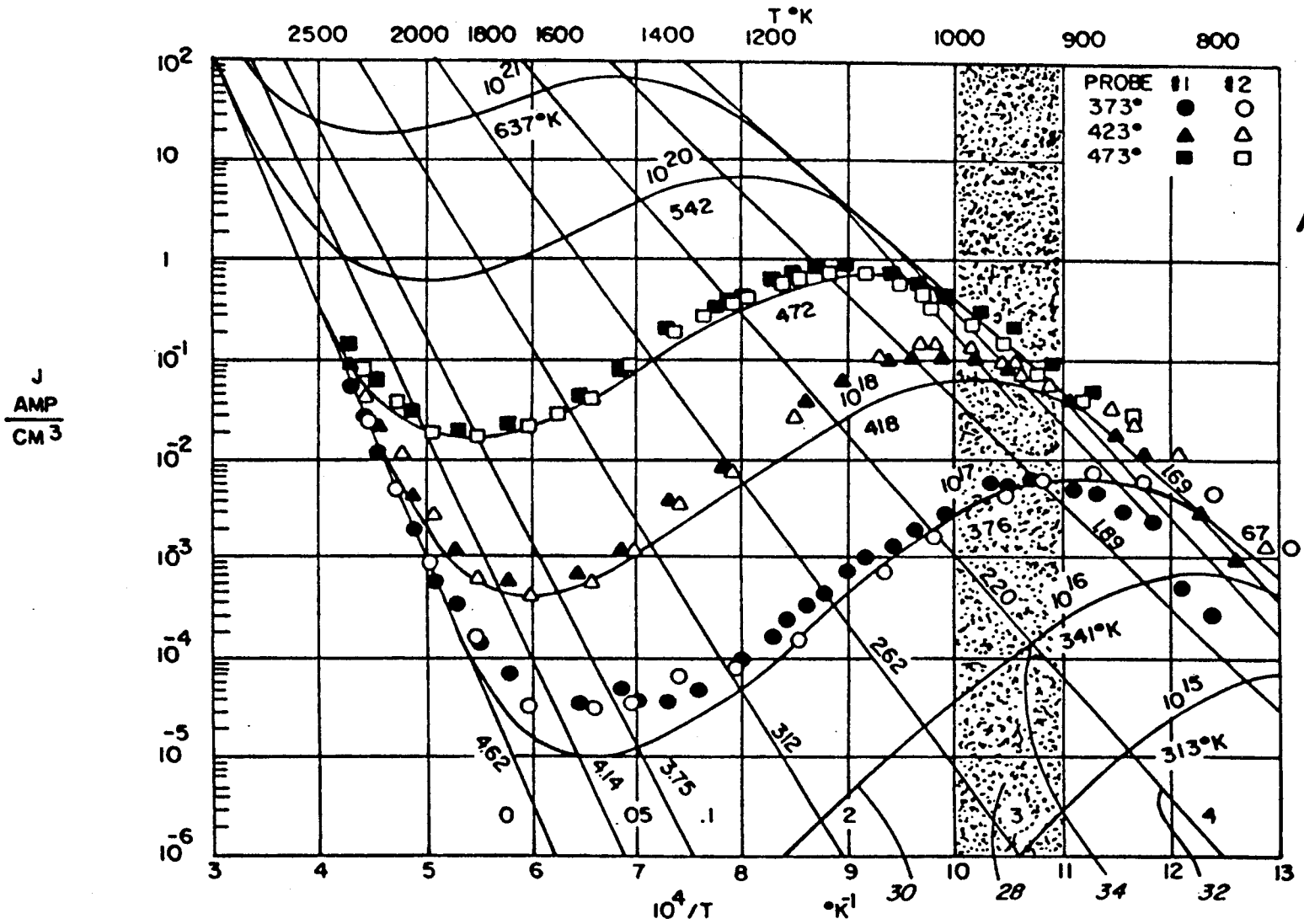
FIG. 3 is a graph illustrating curves of current densities for different electrode temperatures and listing corresponding work functions of cesium coated tungsten electrodes.

FIG. 3 shows isothermal s-shaped curves for electron emission in a system that employs a cesium film on a tungsten electrode. The graph shows current densities for different electrode temperatures. The isotherm is defined as the temperature of the bath for a pure cesium system. The depicted linear curves represent different cesium surface coverage on tungsten electrodes and hence, have different work functions. The typical operating temperature of the anode in a mercury negative glow discharge lamp is between 900° and 1000° K. which is shown as the shaded area and labeled 28 in FIG. 3. The lamp operates within this temperature range so as to not disturb the mercury radiation function of the lamp.

A typical cesium bath temperature of 341° K. (=68° C.), which corresponds to a cesium vapor pressure of approximately $7.0\times10^{-5}$ Torr, is depicted in the graph as the isothermal s-shaped curve labeled 30. This curve intersects with the cesium surface coverage linear curve labeled 32 (with a corresponding work function equal to 2.2 electron volts as labeled) in the allowable electrode operating temperature range 28 at point 34. This shows that for a cesium bath temperature of 341° K., the tungsten anode work function would be reduced to 2.2 electron volts (by the introduction of cesium), from a pure tungsten work function of 4.55 electron volts. With the same 2.0 amp discharge current, as used in the example above, an energy savings of 4.7 W is achieved, which is more than 50% of the power which would be wasted without the cesium introduction. The procedure used to determine how much cesium to introduce to the mercury based fill material is outlined below.

This concept of using absorbed cesium on the tungsten anode to decrease the work function requires cesium gas to be present in the fill material. A cesium-mercury negative glow discharge lamp has reduced efficiencies when compared to a mercury negative glow discharge lamp, when solely considering fill material radiation adding to the lumens output of the lamp and ignoring the work function reduction. This is because of an additional energy channel, the excitation of the resonance lines of cesium (with wavelengths of 852 nm and 894 nm), which does not add to the total lumens output of the lamp. Therefore, a balance is to be reached so that sufficient cesium is introduced to reduce the work function of the anode but not enough to have a deteriorative effect on the total lumens output from the lamp.

Computer simulation studies were performed to study the lumens output behavior of the cesium-mercury negative glow discharge lamp at various cesium vapor pressures, ignoring the energy gain due to the work function reduction. These studies revealed the lumens efficiency loss due to the cesium radiation. The object of the study was to find the maximum cesium vapor pressure such that the lumens efficiency, while ignoring the work function gain, is not more than 3.0% below that of a mercury negative glow discharge lamp operating under similar conditions. The results are shown in FIGS. 4 and 5.

Figure 4:
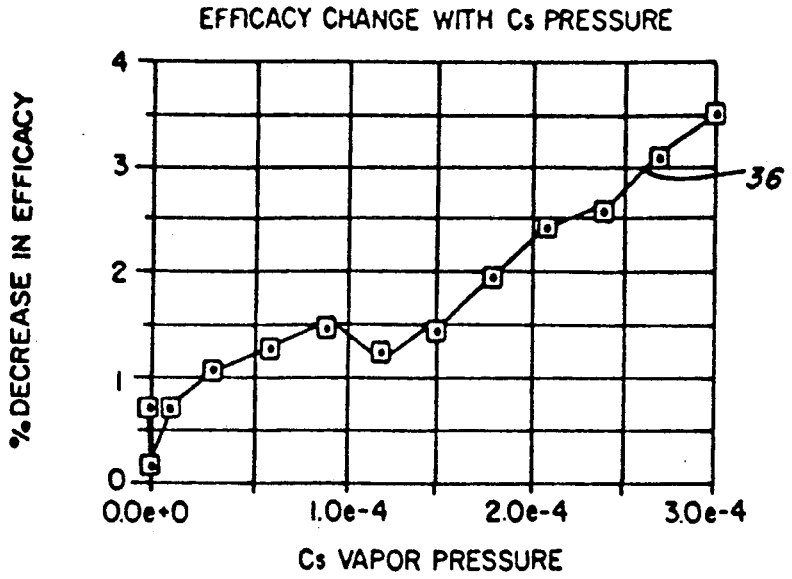
FIG. 4 is a graph which illustrates the decrease in efficiency of the lamp with respect to the cesium radiation loss for different cesium vapor pressures.
Figure 5:
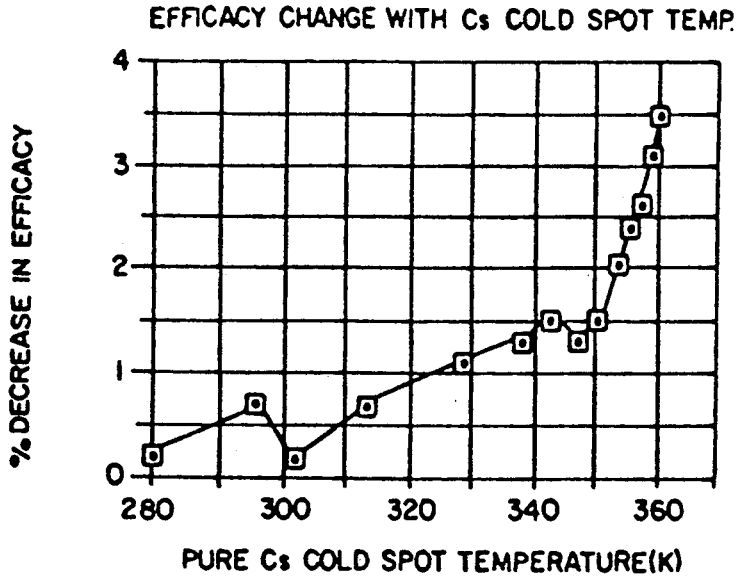
FIG. 5 is a graph which illustrates the decrease in efficiency of the lamp with respect to the cesium radiation loss for different cesium cold spot temperatures.

FIG. 4 shows a graph of the percentage decrease in lumens efficiency with respect to a mercury negative glow discharge lamp for varying cesium vapor pressures. FIG. 5 shows the same percentage decrease for varying cesium cold spot temperatures, which correspond to different isotherms in FIG. 3. The parameters used are a mercury vapor pressure of $4\times10^{-3}$ Torr and a discharge current of 2.0 A.

Choosing the tolerable lumens efficiency decrease as approximately 3.0%, the corresponding cesium vapor pressure is between $2\times10^{-4}$ and $3\times10^{-4}$ Torr as can be seen at the point labeled 36 in FIG. 4. This point 36 marks the intersection between the decrease in efficiency curve and the 3.0% decrease in efficiency horizontal line.

Figure 6:
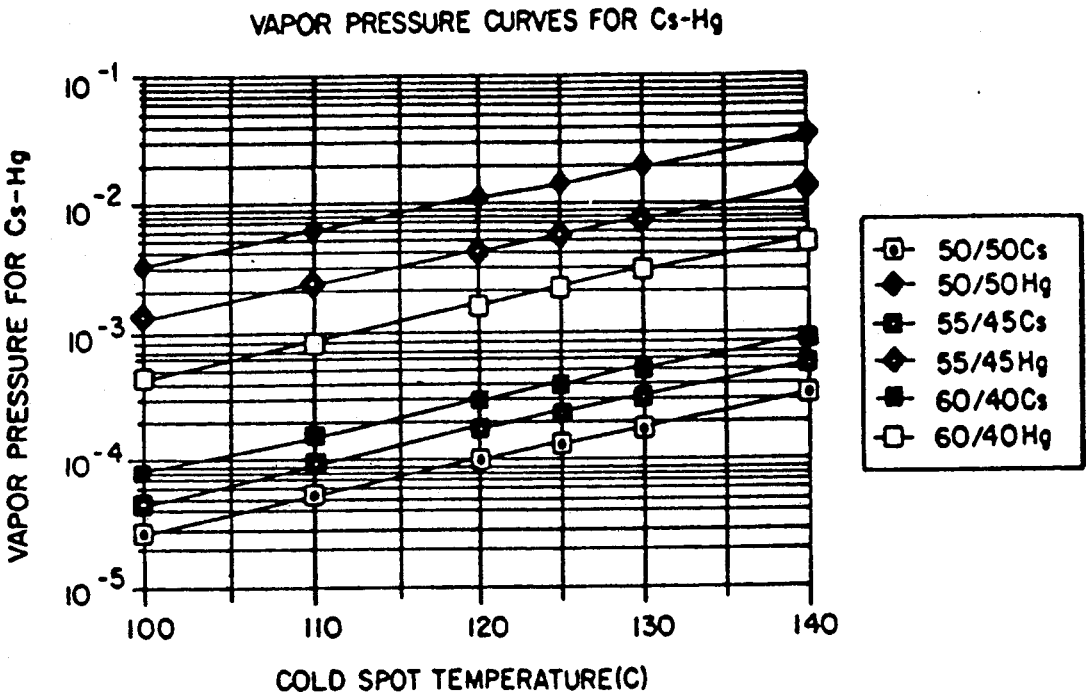
FIG. 6 is a graph illustrating curves of cesium-mercury weight ratios for corresponding vapor pressures and cold spot temperatures.

Knowing the cesium and mercury vapor pressures, the required fill weights for a cesium-mercury system can be determined. Using the above results, an appropriate range for cesium vapor pressures is between $2\times10^{-4}$ and $4\times10^{-4}$ Torr. A typical range for mercury vapor pressures is between $4\times10^{-3}$ and $9\times10^{-3}$ Torr. The results, shown in FIG. 6, for different cesium amalgams, indicate that to obtain the correct cesium and mercury vapor pressures, the desired results are obtained with the use of a preferred amalgam consisting of 55 percent by weight of cesium and 45 percent by weight of mercury operating at a cold spot temperature of approximately 120° C.

In addition to the preferred amalgam of cesium and mercury, it has been found that the weight of cesium and mercury can vary basically between 40 percent and 60 percent. For example, the amalgam may consist of 60 percent by weight of cesium and 40 percent by weight of mercury. At the other extreme, the amalgam may consist of 40 percent by weight of cesium and 60 percent by weight of mercury. Moreover, sodium may be used instead of cesium, in combination with mercury and a noble gas, as the fill material. The same percentages by weight also apply with regard to the use of sodium in place of cesium.

Figure 2:
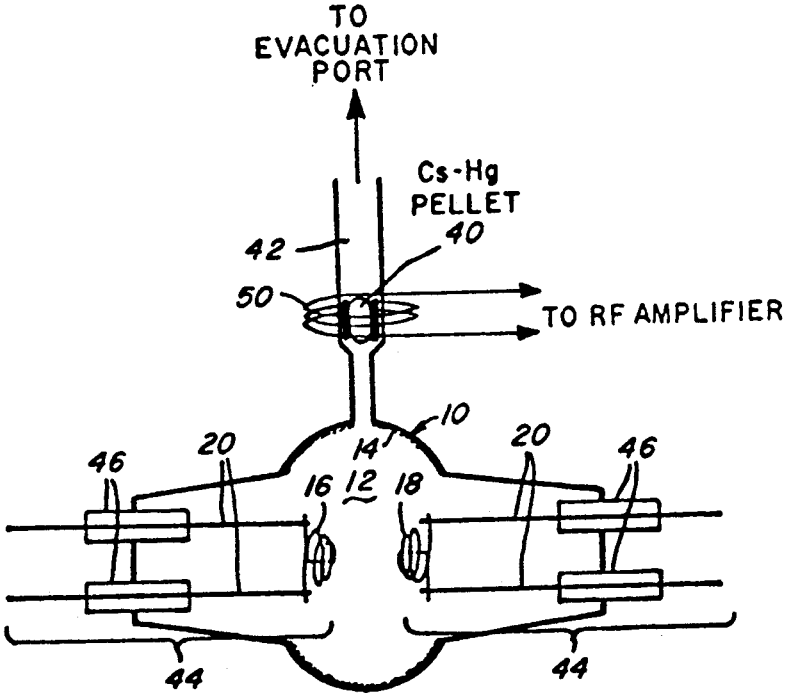
FIG. 2 illustrates an intermediate step in the fabrication of the lamp, particularly relating to the filling thereof.

In connection with the mode of fabrication of a lamp in accordance with the present invention, reference can also be made to FIG. 2 which essentially shows an intermediate step in the method of manufacture, the step in particular relating to providing the cesium portion of the fill material.

More particularly, FIG. 2 illustrates the employment of an A-23 incandescent lamp envelope 10 which is internally coated with a phosphor blend 14. A pellet of cesium-mercury 40, with a predetermined ratio of mercury to cesium, is placed in the larger diameter exhaust tube 42. The electrode mount assembly 44 comprises of a multi-pin wafer stem 46 with attached lead-in wires 20 made from 0.02 inch diameter nickel wire. Electrodes are then clamped on the ends of each pair of lead-in wires. Number 41 triple coil tungsten exciters are used with one coiled electrode and coated with an emissive coating to serve as the cathode 16. The other electrode is left bare to serve as the anode 18.

The lamp is then evacuated and baked in an oven to a temperature of approximately 400° C. The cathode is then activated in a tightly sealed vacuum by heating it to about 1250° C. The cesium-mercury amalgam in the pellet is then rapidly heated with an RF field 50 to convert it to a liquidous state. Then, a burst of neon gas (approximately 300 Torr) is used to force the amalgam into the lamp envelope. The lamp is then filled with 2–3 Torr of neon gas and the lamp is tipped off. Finally, the lamp is placed in the infrared reflecting evacuated outer jacket 11.

As indicated previously, in the preferred embodiment of the present invention, a cesium gas is used in the fill material of a negative glow discharge lamp. This increases the efficiency of the lamp when compared to a mercury negative glow discharge lamp. With the present invention, energy losses due to electrons losing power because of the potential energy barrier work function of the tungsten substrate can be reduced by almost 50%.

Although a preferred embodiment of the invention has been illustrated, it will be readily apparent to those skilled in the art that various modifications may be made therein without departing from the spirit of the present invention as defined by the appended claims.

What is claimed is:

1. A method of constructing a glow discharge lamp having an anode and a cathode, said method comprising the steps of providing an envelope having an exhaust tube, depositing within the exhaust tube an amalgam of mercury and a metal which when vaporized within the lamp is effective for reducing the work function of the anode to thereby enhance the efficacy of the lamp, heating the amalgam within the exhaust tube and introducing the amalgam in a liquid state into the envelope, filling the envelope also with a rare gas and tipping the exhaust tube off.

2. The method as set forth in claim 1 including rapidly heating the amalgam in the exhaust tube with an RF field to convert the amalgam to a liquidous state.

3. The method as set forth in claim 1 including the step of depositing within the exhaust tube an amalgam of mercury and a metal selected from the group consiting of cesium and sodium.

* * * * *